United States Patent [19]

Instance

[11] Patent Number: 4,592,572

[45] Date of Patent: Jun. 3, 1986

[54] RESEALABLE CONTAINER LABELS

[76] Inventor: David J. Instance, Past Heap Farm, Pembury, Tunbridge Wells, Kent, England

[21] Appl. No.: 622,269

[22] Filed: Jun. 19, 1984

[30] Foreign Application Priority Data

Jun. 21, 1983 [GB] United Kingdom ..... 8316796

[51] Int. Cl.[4] ..... B42D 15/00; B42D 15/04

[52] U.S. Cl. ..... 281/2; 40/306; 283/81; 283/79; 283/80

[58] Field of Search ..... 40/306, 310, 312; 281/2, 5; 283/79, 80, 81, 103, 105, 61, 62

[56] References Cited

U.S. PATENT DOCUMENTS

| | | | |
|---|---|---|---|
| 1,896,834 | 2/1933 | Brown | 40/306 |
| 1,924,909 | 8/1933 | Brown . | |
| 2,127,081 | 8/1938 | Brown | 40/306 |
| 4,010,299 | 3/1977 | Hershey, Jr. et al. | 40/306 |
| 4,097,067 | 6/1978 | Schechter | 283/62 X |
| 4,323,608 | 4/1982 | Denny et al. | 40/306 X |

FOREIGN PATENT DOCUMENTS

| | | |
|---|---|---|
| 0043179 | 6/1982 | European Pat. Off. . |
| 0087987 | 7/1983 | European Pat. Off. . |
| 2611996 | 9/1977 | Fed. Rep. of Germany . |
| 2115775 | 9/1983 | United Kingdom . |

*Primary Examiner*—Paul A. Bell

*Attorney, Agent, or Firm*—Burns, Doane, Swecker & Mathis

[57] ABSTRACT

A label for affixing to a container comprising a longitudinal strip 2 divided into a series of panels (10, 11, 12, 13) by a plurality of transverse fold lines (14, 15, 16), the first two panels (10, 11) forming a front cover 10 and a back cover 11 respectively for enveloping the remaining panel or panels (12, 13) of the strip 2 when folded, the transverse fold lines (14, 15, 16) being spaced along the strip 2 so that upon folding of the strip the said remaining panel or panels is or are folded to lie over the back cover 11 and is or are in turn covered by folding of the front cover 10 about the fold line 14 between the front and back covers; and a support web 26 to which the said back cover 11 is adhered, the support web 26 being dimensioned to extend laterally at least beyond the edge of the back cover which occurs at the fold line 15 between the back cover 11 and the remaining panel or panels, (12, 13) the front cover panel 10 being dimensioned so that its free outer edge 18 opposite to the fold line 14 between the front and back cover panels extends beyond the area of the support web occupied by the back cover 11 thereby to form an overlapping portion 22, the area of the support web 26 which in use lies below the said overlapping portion 22 being provided with adhesive 24 for securing the front cover panel in a closed condition, and the front cover panel 10 being arranged to be torn or otherwise opened to give access to the interior of the folded label.

7 Claims, 9 Drawing Figures

RESEALABLE CONTAINER LABELS

Figure 1:
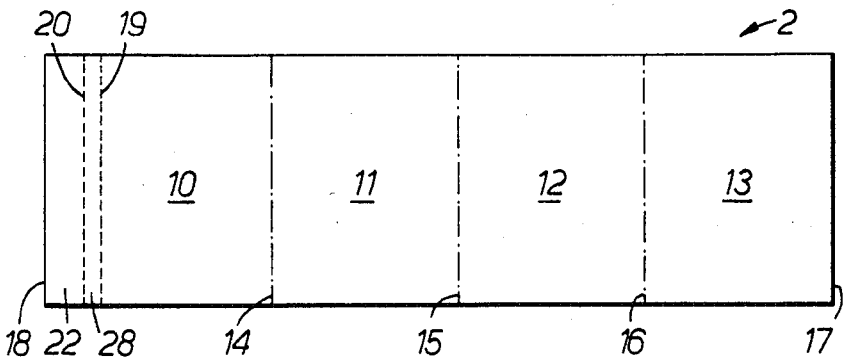

The present invention relates to labels, and more particularly to labels intended to be attached to containers such as boxes, packets, bottles or tins.

Owing to present day regulations governing the information which manufacturers have to provide to customers when selling products, particularly chemical products such as agrochemicals, pesticides, and industrial chemicals in general, it is becoming necessary to give an ever-increasing amount of information to the customers of the products; it is often necessary to supply the information on the container of the product rather than on a separate sheet supplied with the container.

One convenient way of arranging for this textual information to appear on the container is to supply it on the label of the container. However, it is often the case that the label, or even the container itself, is not large enough to accommodate all the information which the manufacturer must supply to the purchaser of the product.

I have already proposed in my U.K Patent Specification No. 2115775 a folded label which overcomes this general problem. In my earlier patent the folded label includes a front cover which can be torn or otherwise opened to allow for access to the interior of the label and for subsequent unfolding of the label thereby to reveal the printed textual matter on the folded parts of the label. In the label described in my earlier Patent Application, the front cover panel is secured in a closed condition by providing a band of adhesive on the inner face of the free outer edge of the front cover panel adjacent to said outer edge. My earlier application describes embodiments which include a support web for carrying the folded label and I have now found that it is more convenient when manufacturing some labels of this type not to provide a band of adhesive of the inner face of the free outer edge of the front cover panel as a means of securing the front cover panel in a closed condition, but instead to provide adhesive on the upper face of the support web, for adhering to the front cover panel when this is folded over into its closed condition.

Accordingly, the present invention provides a label for affixing to a container comprising a longitudinal strip divided into a series of panels by a plurality of transverse fold lines, the first two panels forming a front cover and a back cover respectively for enveloping the remaining panel or panels of the strip when folded, the transverse fold lines being spaced along the strip so that upon folding of the strip the said remaining panel or panels is or are folded to lie over the back cover and is or are in turn covered by folding of the front cover about the fold line between the front and back covers; and a support web to which the said back cover is adhered, the support web being dimensioned to extend laterally at least beyond the edge of the back cover which occurs at the fold line between the back cover and the remaining panel or panels, the front cover panel being dimensioned so that its free outer edge opposite to the fold line between the front and back cover panels extends beyond the area of the support web occupied by the back cover thereby to form an overlapping portion, the area of the support web which in use lies below the said overlapping portion being provided with adhesive for securing the front cover panel in a closed condition, and the front cover panel being arranged to be torn or otherwise opened to give access to the interior of the folded label.

If desired, the label may additionally comprise at least one further row of panels, for example one, two or more further rows of panels, hingedly connected along one or both longitudinal edges of the said longitudinal strip of panels. The or each further row of panels may extend parallel to or perpendicular to the longitudinal strip of panels.

Alternatively, the label may additionally comprise at least one further panel hingedly connected along one or both longitudinal edges of the said longitudinal strip of panels.

In one arrangement the front cover panel of the label includes at least one weakened tear line along which the front cover panel can be severed to allow for the required access to the interior of the label. Preferably, the front cover panel includes two parallel weakened tear lines, spaced apart to provide a narrow strip which can be torn away to give access to the interior of the label.

In an alternative arrangement, the inner face of the overlapping portion of the front cover panel has applied thereto a material which renders the paper hydrophobic thereby to allow the front cover to be selectively detached from and re-attached to the support web so as to be able repeatedly to open and close the folded label. Furthermore, the front cover may be dimensioned so that its lower edge extends beyond the area of the support web occupied by the back cover thereby to form a lower overlapping portion and the area of the support web which in use lies below the lower overlapping portion is provided with adhesive for securing the lower edge of the front cover panel.

Preferably, a succession of labels in accordance with the present invention is adhered to the upper surface of a length of a release backing material and wound into a reel for subsequent removal of the labels from the backing material and application to a container to be labelled.

Figure 2:
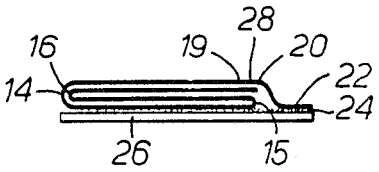
Figure 3:
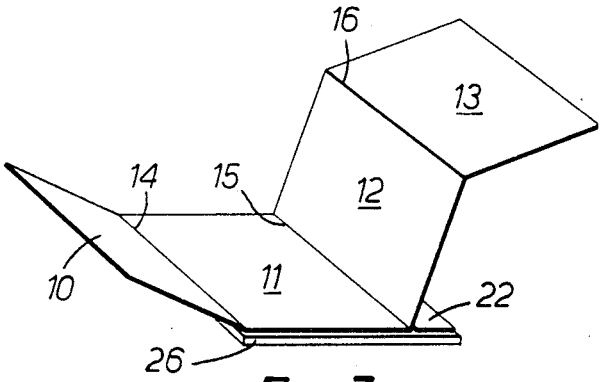
Figure 4:
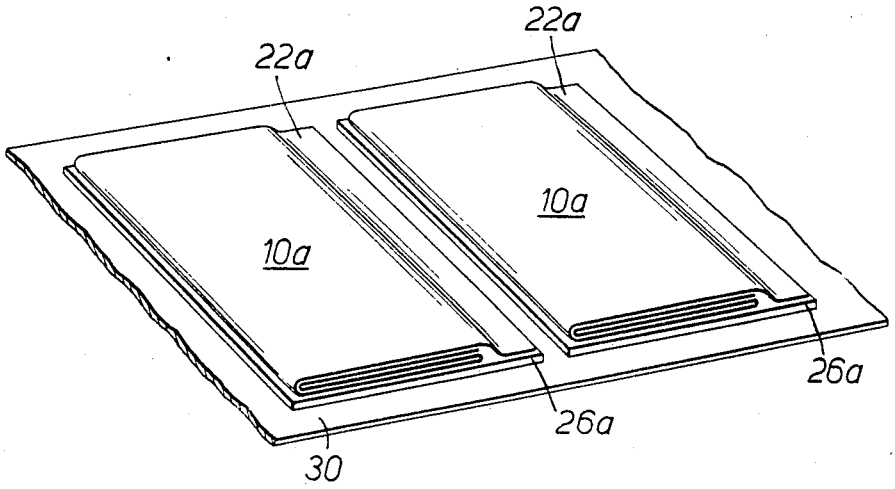
Figure 5:
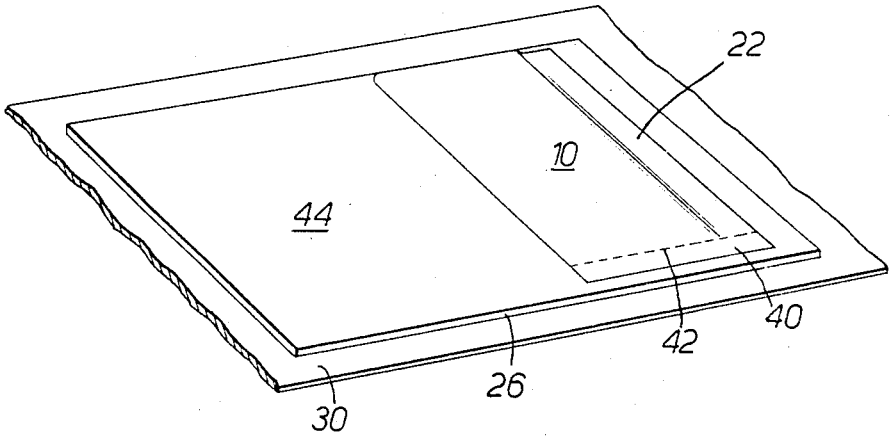

Various embodiments of the invention will now be described, by way of example only, with reference to the accompanying drawings, in which:

FIG. 1 illustrates a plan view of a label in accordance with the invention before folding, FIG. 2 shows a side view of the label of FIG. 1, after folding, FIG. 3 shows a perspective view of the label of FIGS. 1 and 2 after tearing of the weakened tear lines and unfolding of the label, FIGS. 4 and 5 illustrate further embodiments of a label in accordance with the present invention, and FIGS. 6, 7, 8 and 9 illustrate further embodiments of a label in accordance with the present invention including additional panels or additional rows of panels.

In the Figures, like reference numerals refer to like parts.

Referring to FIGS. 1 and 2, a label in accordance with the invention is made from a longitudinal strip 2 of paper, which is divided by transverse fold lines 14, 15, 16 into four panels 10, 11, 12, 13; these fold lines need not exist prior to the folding operations used to form the label during its manufacture. The upper surface of each of panels 10, 11, 12 and 13 may carry printed information as can the lower surface of each of panels 10, 12, and 13. The lower surface of panel 11 is adhered to a support web 26 by a layer of adhesive 24 as is an overlapping portion 22 of the front cover panel 10 when the label is in a closed condition. The support web 26 also has an adhesive on its underside suitable for adhering the support web together with its associated folded strip of panels to a container.

In use, the label is folded as shown in FIGS. 2 and 3 by doubling the panel 13 on the right-hand side of the label about fold line 16 so that it lies against the back of panel 12, and thereafter doubling panels 12 and 13 together about fold line 15 so that they lie against the inner face of panel 11. Panel 11 acts as a back cover for folded panels 12 and 13. Finally, panel 10 on the left-hand side of the strip 2 is folded about fold line 14 to lie over folded panels 12 and 13 and thereby to act as a front cover for the folded panels of the label. The fold lines 14, 15 and 16 on the strip 2 are spaced from one another in such a manner that panels 12 and 13 after folding are both contained within the front and back cover panels 10 and 11, and the width of the cover panel 10 is such that the cover panel has a main overlapping portion 22 which in the folded condition extends beyond the right-hand edge of the folded panels 12 and 13. In the closed condition of the label, this main overlapping portion 22 of the cover panel 10 is secured to adhesive 24 which is present on the upper face of the support web 26. To allow for opening of the label, there are provided on the panel 10 two parallel weakened tear lines 19 and 20 located slightly inwardly of the overlapping portion 22 of the panel 10 and spaced slightly apart to provide a narrow strip 28 which can be torn away to give access to the interior of the label by allowing the front cover panel 10 and other panels of the label to be unfolded. When the strip 28 is removed in order to gain access to the information on the inside of the label, the overlapping portion 22 of the cover panel 10 remains attached to the support web 26.

Although the above described embodiments of the labels of the present invention have been shown as having two weakened tear lines 19 and 20, it is possible to have only a single tear line. The tear line or tear lines need not be positioned immediately adjacent the overlapping portion 22 and may be positioned along any transverse axis of the front cover panel 10 parallel to the fold lines. For example, a single tear line 20 may be located parallel to and adjacent the fold line 14 on the left-hand side of front cover panel 10.

In some embodiments of the label of the present invention, the area of the support web 26 is greater than that of the folded portion of the label, the support web 26 then providing additional panels 44 for carrying further printed matter. A typical label of this type is shown in FIG. 5.

If desired, as shown in FIG. 4, a number of labels in accordance with the invention are carried in succession on a length of release backing material 30 which for convenience of handling is wound into a reel which when subsequently labelling containers, can be unwound so that the labels can be removed from the backing material and applied to containers to be labelled.

Apart from the underside of panel 11 which is adhered to the support web 26, the upper and lower faces of all the other panels, 10, 12 and 13 may each carry printed instructions or any other desired information. The outer face of cover panel 10 will generally carry instructions indicating how to gain access to the information printed inside the label, for example by tearing off the strip 28 between tear lines 19 and 20. If desired, printed lines may be used to indicate where the label should be torn along the weakened tear lines. Having removed the strip of material 28 between tear lines 19 and 20, or torn the front cover panel along a single weakened tear line 20, the cover panel 10 can be unfolded about fold line 14 allowing access to the information contained on panels 11, 12 and 13 by unfolding along fold lines 15 and 16 as shown in FIG. 3.

In FIG. 4 there is shown an alternative embodiment of a label in accordance with the present invention. The dimensions and arrangement of the panels of this label are the same as those of the label described in FIGS. 1 to 3. However, in order to make the front cover panel **10*a* re-sealable to the adhesive layer on the upper surface of the support web 26*a* thereby to be able to return the label to its closed condition once it has been opened, instead of providing the cover panel 10*a* with one or more weakened tear lines to allow for opening of the closed front cover panel, the inner face of the overlapping portion 22*a* of the front cover panel has applied thereto a material which renders the paper of the label hydrophobic. This allows the front cover panel 10*a* to be selectively detached from and re-attached to the adhesive on the support web 26*a*** and enables the folded label to be repeatedly opened and closed. An example of a suitable such material for rendering the inner face of the overlapping portion hydrophobic is a polysiloxane manufactured under the code name WS70M and WS78L by Wacker and sold in Great Britain by Ambersil Limited, Basingstoke, Hants., United Kingdom as Silicone Fluid F100.

When a material which renders the paper of the label hydrophobic is applied to the inner face of overlapping portion **22*a*** preferably the adhesive layer consists of a water-borne pressure sensitive adhesive, such as an acrylic copolymer pressure sensitive adhesive. A particularly preferable adhesive is an adhesive sold by National Adhesives, of Slough, Berkshire, United Kingdom, under the trade name Nacor 360.

One disadvantage of using a polysiloxane is the tendency of the polysiloxane to migrate or spread by capillary action along the fibres in the paper across the paper surface. Hitherto, due to that tendency to migrate, materials such as polysiloxanes have been considered only for applications where the polysiloxane is to be spread over a large area on a surface of a material such as paper where the edges of the polysiloxane layer are defined by the edges of the material itself. In the past, due to the migration of the polysiloxane it has proved difficult to define on the surface of a paper web the edge of a layer of polysiloxane. The migration tends to reduce the resealability of the label and results in a messy overlapping portion.

A further disadvantage of using polysiloxane is that it is generally difficult to achieve satisfactory resealability, especially when the label is to be opened and closed a number of times. The formulations of the adhesive and of the polysiloxane must be closely controlled so as to provide sufficient adhesive strength of the adhesive and sufficient hydrophobic strength of the polysiloxane in order to provide a sufficiently strong and resealable bond.

In accordance with a further preferred embodiment of the invention, the material which renders the paper of the label hydrophobic consists of a mixture of a polysiloxane, such as that described above, and a varnish. Preferably the varnish is an overprinting varnish of the type which is in common use in the printing industry. An example of such a varnish is an overprinting varnish made by Fishburn and having the code name XF 05546. Preferably, the mixture contains from 90 to 99.5 vol % polysiloxane and from 0.5 to 10 vol % varnish, the percentage values being based on the total volume of the mixture.

The incorporation of the varnish into the polysiloxane substantially overcomes the above-described two disadvantages of polysiloxane. First, it is possible to apply a well defined band of the mixture to the inner face of overlapping portion with substantially no migration of the polysiloxane across the edges of the band. It is believed that the migration of the polysiloxane is prevented by the relatively rapid hardening of the varnish after the application of the mixture thereby retaining the polysiloxane within the confines of the band as originally applied. Second, the resealability of the label is improved since the presence of the varnish tends to enhance the adhesion of the adhesive onto the overlapping portion, even after the label has been opened and closed a number of times. Furthermore, there is sufficient polysiloxane to allow the label readily to be opened. In practice, the amount of varnish should preferably not exceed 10 vol % of the volume of the mixture otherwise there is a tendency for the adhesive to adhere too firmly to overlapping portion which can result in the label being torn when opened.

In addition, the amount of varnish should preferably not be less than 0.5 vol % of the volume of the mixture otherwise the effect of the varnish is not significant and migration of the polysiloxane can occur and the resealability of the label is reduced.

In a modification of the embodiment of the label of FIG. 4, as illustrated in FIG. 5, in order to prevent the front cover panel from becoming opened unintentionally, for example before the containers are delivered to customers, the front cover panel is dimensioned so that its lower edge extends beyond the area of the support web 26 occupied by the back cover panel to form a lower overlapping portion 40. The area of the support web 26 which lies below this lower overlapping portion 40 is also coated with adhesive 24 and, when the folded strip of panels is applied to the support web, causes the lower overlapping portion of the front cover panel to become secured to the support web. In order to allow for access to the interior of the folded label, one or more weakened tear lines 42 are provided inwardly of the said lower overlapping portion. By scoring or tearing of the weakened tear line 42, the front cover panel can then be opened and the remaining panels of the label unfolded to reveal the printed text thereon. To close the label, the various panels are re-folded to lie over the back cover panel 11 and front cover panel 10 is folded over and the overlapping portion 22 is pressed against the adhesive 24 on the support web thereby to secure the front cover panel in a closed condition. To re-open the folded label, the overlapping portion 22 of the front cover panel need only be peeled away from the layer of adhesive to which it is attached.

In addition, the label of FIG. 5 shows an embodiment in which the surface area of the support web 26 is greater than that of the folded strip of panels thereby providing additional surface area 44 for carrying printed information.

It will be appreciated that although the labels described above have been illustrated as having only two panels to the right of back cover panel 11, if a greater amount of information must be provided on the label, a longer strip may be used and this may be folded so that there are three or more panels beyond the back cover panel 11. Indeed, further panels may be included above, below or above and below the strip of panels 11, 12, 13 as is described hereinbelow.

Figure 6:
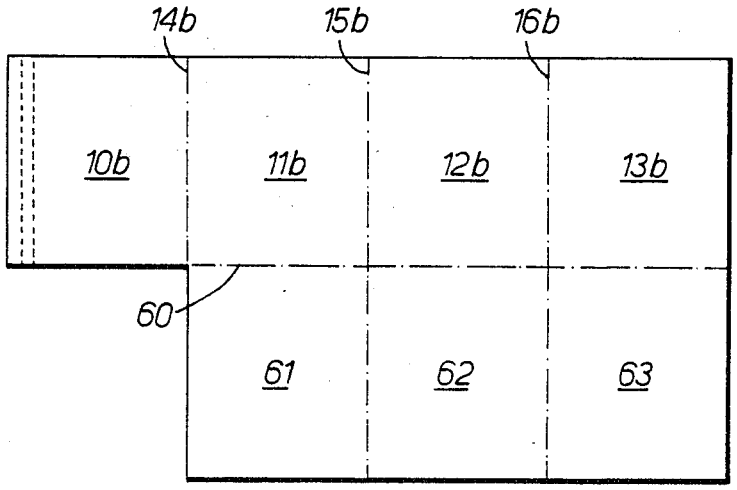
Figure 7:
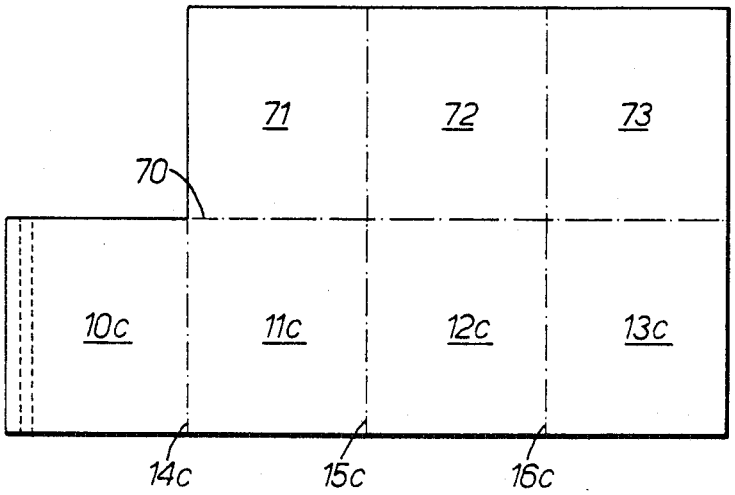
Figure 8:
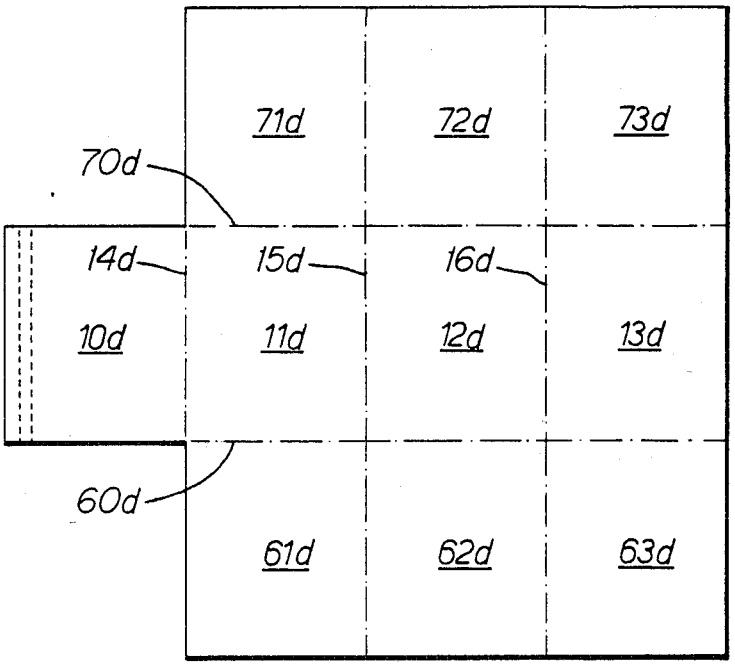

As will be seen from the embodiments of the label shown in FIGS. 6 to 9, if additional areas for printing textual information are required, the label may be designed to include one or more further rows of panels hingedly connected to one or both longitudinal edges of the longitudinal strip of panels. Thus, for example, one additional row of panels (61, 62, 63) may be hingedly connected below the strip of panels (**10*b*, 11*b*, 12*b*, 13*b*) as shown in FIG. 6, or similarly one additional row of panels (71, 72, 73) may be hingedly connected above the strip of panels (10*c*, 11*c*, 12*c*, 13*c*) as shown in FIG. 7. If desired, one, or more, such additional rows may be added both above and below the longitudinal strip of panels (10*d*, 11*d*, 12*d*, 13*d*) as shown in FIG. 8**.

In use, the additional rows of panels are folded inwardly about respective fold lines **60*d* and 70*d* along the longitudinal edges of the strip of panels so that they lie flat over the longitudinal strip of panels, and then the resultant strip of panels is folded onto the back cover panel 11*d* and covered by front cover panel 10*d*** as described above to provide a folded label.

Figure 9:
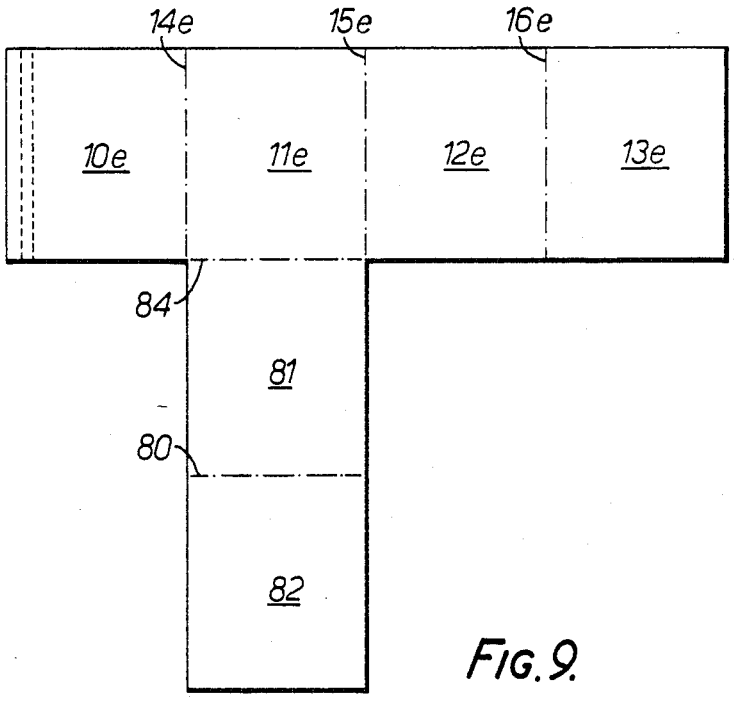

In each of the labels shown in FIGS. 6, 7 and 8 the additional rows of panels are parallel to the longitudinal strip of panels; however, it is also possible, as shown in FIG. 9, to include rows of panels (81, 82) perpendicular to the longitudinal strip of panels (**10*e*, 11*e*, 12*e*, 13*e*). In use, panel 82 is first folded about fold line 80 onto panel 81, and the resultant two-ply layer is folded about fold-line 84 onto panel 11*e*, whereupon panels 12*e* and 13*e* are folded over a described before, followed finally by folding and adhering of the front cover panel 10*e* over the various folded panels lying over rear panel 11*e***.

Alternatively, a single panel such as panel 81 may be hingedly connected to one or both longitudinal edges of the longitudinal strip of panels. This arrangement is not specifically illustrated.

In each case in the embodiments of FIGS. 6 to 9 the front cover panel is arranged to be torn about weakened tear lines or otherwise opened as described above to allow the user to gain access to the interior of the folded label once the label is applied to a container.

Generally to prepare labels in accordance with the invention, a sheet of material is printed as required and cut and folded along longitudinal fold lines corresponding to fold lines 14, 15, 16 to give a multiple-ply folded sheet of printed material.

A continuous length of a support web which has a self-adhesive underside lined with a removable backing sheet of release material 30 is unwound from a reel and the upper face of the support web may, if desired, be printed with repeat texts to provide additional areas of printed information such as panels 44 shown in FIG. 5. The support web, optionally printed, is then passed to a dye-cutting station to cut the support web into a series of labels of desired size and shape, the waste portions of the support web being removed from the release backing material. Thereafter adhesive is applied in a gluing step to the upper surface of the support web, either to substantially the whole of the upper surface thereof when making labels of the type illustrated in FIGS. 1 to 3, or to selected areas of the upper surface when making labels of the type shown in FIG. 5. Thereafter, a multiple-ply folded sheet of printed material is applied to the appropriate area of each of the labels and the resultant labels on the backing sheet are wound into a reel for subsequent removal from the backing sheet and application to a container to be labelled.

It should be noted that in some cases it may be more convenient to reverse the sequence of dye-cutting and gluing steps so that the adhesive is applied to the support web before the web is dye-cut.

What I claim is:

1. A label for affixing to a container comprising a longitudinal strip of paper divided into a series of panels by a plurality of transverse fold lines, the first two panels forming a front cover and a back cover respectively for enveloping the remaining panel or panels of the strip when folded, the transverse fold lines being spaced along the strip so that upon folding of the strip the said remaining panel or panels is or are folded to lie over the back cover and is or are in turn covered by folding of the front cover about the fold line between the front and back covers; and a support web to which the said back cover is adhered, the support web being dimensioned to extend laterally at least beyond the edge of the back cover which occurs at the fold line between the back cover and the remaining panel or panels, the front cover panel being dimensioned so that its free outer edge opposite to the fold line between the front and back cover panels extends beyond the area of the support web occupied by the back cover thereby to form an overlapping portion, the area of the support web which in use lies below the said overlapping portion being provided with adhesive for securing the front cover panel in a closed condition, and the inner face of the overlapping portion of the front cover panel has applied thereto a material which renders the paper hydrophobic, the material containing from 90 to 99.5 vol % polysiloxane and from 0.5 to 10 vol % varnish, thereby to allow the overlapping portion to be selectively detached from and reattached to the adhesive on the said area of the support web so as to be able repeatedly to open and close the folded label.

2. A label according to claim 1, further comprising at least one further panel hingedly connected along one or both longitudinal edges of the said longitudinal strip of panels.

3. A label according to claim 1, further comprising at least one further row of panels hingedly connected along one or both longitudinal edges of the said longitudinal strip of panels.

4. A label according to claim 3, wherein the or each further row extends parallel to the said longitudinal strip of panels.

5. A label according to claim 3, wherein the or each further row extends perpendicular to the said longitudinal strip of panels.

6. A label according to claim 1, wherein the rear face of the support web is provided with adhesive.

7. A reel of release backing material carrying thereon a succession of labels, the labels being labels as claimed in claim 1.

* * * * *